United States Patent [19]
Hamilton
[11] 4,428,616
[45] Jan. 31, 1984

[54] DESK ASSEMBLY FOR A WHEELCHAIR OR THE LIKE

[76] Inventor: Rex Hamilton, 944 S. Court St., Visalia, Calif. 93277

[21] Appl. No.: 318,002

[22] Filed: Nov. 4, 1981

Related U.S. Application Data

[63] Continuation of Ser. No. 86,689, Oct. 22, 1979.

[51] Int. Cl.³ ..... A47B 83/02
[52] U.S. Cl. ..... 297/145; 297/150; 297/155; 297/162; 297/DIG. 4; 108/6
[58] Field of Search ..... 297/145, 150, 155, 162, 297/DIG. 4; 108/6, 63

[56] References Cited

U.S. PATENT DOCUMENTS

| | | | |
|---|---|---|---|
| 1,222,455 | 4/1917 | Packwood | 297/150 |
| 1,888,525 | 11/1932 | Calloway et al. | 297/145 |
| 2,270,557 | 1/1942 | Randall | 108/63 |
| 2,799,324 | 7/1957 | Anderson | 297/145 |
| 2,843,226 | 7/1958 | Nordmark | 108/6 |
| 3,197,254 | 7/1965 | Hendrickson | 297/162 |
| 3,371,956 | 3/1968 | Jordan et al. | 297/162 |
| 3,547,488 | 12/1970 | Barnes | 297/162 |
| 3,632,161 | 1/1972 | Arfaras | 297/145 |
| 3,999,798 | 12/1976 | Roulier | 297/150 |

*Primary Examiner*—Francis K. Zugel
*Attorney, Agent, or Firm*—Manfred M. Warren; Robert B. Chickering; Glen R. Grunewald

[57] ABSTRACT

A desk assembly for mounting to and carrying by a wheelchair or the like in the location of a conventional armrest is disclosed. The desk assembly extends across the lap of the user of the wheelchair in a deployed position, folds to a relatively compact condition, and is pivotally movable to a stored position located where a conventional armrest would be provided. The desk assembly is further formed for selective locking of the desk top in various sloped orientations and movement of the desk top toward or away from the user. A reading lamp is also provided for the desk assembly.

8 Claims, 8 Drawing Figures

DESK ASSEMBLY FOR A WHEELCHAIR OR THE LIKE

This is a continuation of application Ser. No. 86,689, filed Oct. 22, 1979.

BACKGROUND OF THE INVENTION

Both wheelchair and invalid chairs have been constructed which include tray or writing desk assemblies. Many of the trays which have been provided on invalid chairs, however, are two bulky for mounting to and use on a wheelchair. Accordingly, wheelchair-mounted trays tend either to be undesirably small or so bulky that they must be removed and stored apart from the chair, often by an attendant.

U.S. Pat. Nos. 3,870,362; 3,860,285; 3,788,695; 3,580,631; 3,575,466 and 3,123,397 are examples of relatively bulky trays or desk assemblies that are designed primarily for use with invalid chairs. Such invalid chairs are normally propelled by an attendant and do not have large drive wheels, as would be conventionally found in a wheelchair. Accordingly, many of the structures disclosed in these patents employ large tray assemblies which are movable to a stored position at the side of the invalid chair. While adequate for invalid chairs, these tray and desk assemblies would conflict or interfere with the drive wheels present on conventional wheelchairs.

U.S. Pat. Nos. 3,547,488; 2,799,324 and 1,217,231 disclose desk tops or trays which are mounted to highchairs, classroom chairs and the like. Again, the absence of any drive wheel structure from the chair to which the desk or tray is mounted has produced structures in which the desk top is merely supported from a side of the chair when in the stored position. These structures, therefore, tend to be adequate for the chairs to which they are mounted, but inadequate for use with a wheelchair. U.S. Pat. No. 3,999,798 is typical of a tray assembly that is mounted to a wheelchair and is foldable to a compact stored position along the side of the chair. In order to enable storing directly on the chair, the tray of U.S. Pat. No. 3,999,798 is relatively small, enabling the same to be stored in a location which is almost entirely in advance of the wheelchair drive wheels.

Trays or desk top structures which are designed to be attached to the wheelchair arm structure in a manner similar to the tray on a baby's highchair have the further negative psychological impact on the user of suggesting that the disabled person is as helpless as an infant. This is coupled with the inherent awkwardness of such removable trays and the likelihood that they will often not be available when they are needed.

OBJECTS AND SUMMARY OF THE INVENTION

A. Objects of the Invention

Accordingly, it is an object of the present invention to provide a desk assembly for mounting to a wheelchair or the like which can be collapsed to a compact condition for storage on the wheelchair and deployed by the disabled person without assistance to provide a relatively large and useful desk top or tray across the lap of the disabled person.

It is another object of the present invention to provide a desk assembly for a wheelchair or the like which can be mounted to a wide variety of different types of wheelchairs.

Another object of the present invention is to provide a desk assembly for a wheelchair which does not substantially increase or alter the overall bulk of the wheelchair and is compatible and does not interfere with the wheelchair drive wheel structure.

Still a further object of the present invention is to provide a desk assembly for mounting to a wheelchair which is formed to enable selective positioning of the desk top in sloped or horizontal orientations.

Still a further object of the present invention is to provide a desk assembly for mounting to a wheelchair which is formed to provide an armrest structure when the desk assembly is in a stored position on the wheelchair.

Another object of the present invention is to provide a desk assembly for a wheelchair in which a lip is provided to restrict objects from falling off the desk top.

Still another object of the present invention is to provide a desk assembly for mounting to a wheelchair which is formed for illumination of the desk top.

A further object of the present invention is to provide a desk assembly for mounting to a wheelchair that can be moved toward or away from the wheelchair user.

Another object of the present invention is to provide a combination wheelchair and desk assembly which is relatively inexpensive to manufacture, easy to operate, durable and requires a minimum of maintenance.

The desk assembly of the present invention has other objects and features of advantage which will become more apparent from and are set forth in detail in the following description of the preferred embodiment and accompanying drawing.

B. Summary of the Invention

The desk assembly of the present invention includes desk top means, mounting means formed to mount the desk top means to a side of a wheelchair, invalid chair or the like, and pivot means coupling said desk top means the remainder of said desk assembly and formed for movement of said desk top means to and from a deployed position extending across and above the seat of the wheelchair and a stored position proximate a side of the wheelchair. In the improved desk assembly of the present invention the pivot means is formed for movement of the desk top to a stored position at a location at which an armrest structure for the wheelchair would conventionally be positioned. The desk top is formed for selective collapsing to relatively compact size configuration for positioning in the stored position between the wheelchair seat and the drive wheels of the wheelchair. The pivot means is further preferably formed for selective securement and latching of the desk top in various sloped positions, and the desk top may advantageously be provided as two members integrally mounted to each other for pivotal movement about a horizontal axis extending across the chair. The desk top can also include a lip to restrict objects against falling off the top, a light mounted to the inside of the lip, and armrest padding mounted to the outside of the lip. When the desk assembly is in the stored position, the padding extends along a side of the wheelchair, as would the padding on a coventional armrest. The mounting means for attaching the assembly to the wheelchair further is preferably adjustable to accommodate different wheelchair dimensions and is formed for movement of the desk top toward or away from the user.

DESCRIPTION OF THE PREFERRED EMBODIMENTS

Figure 1:
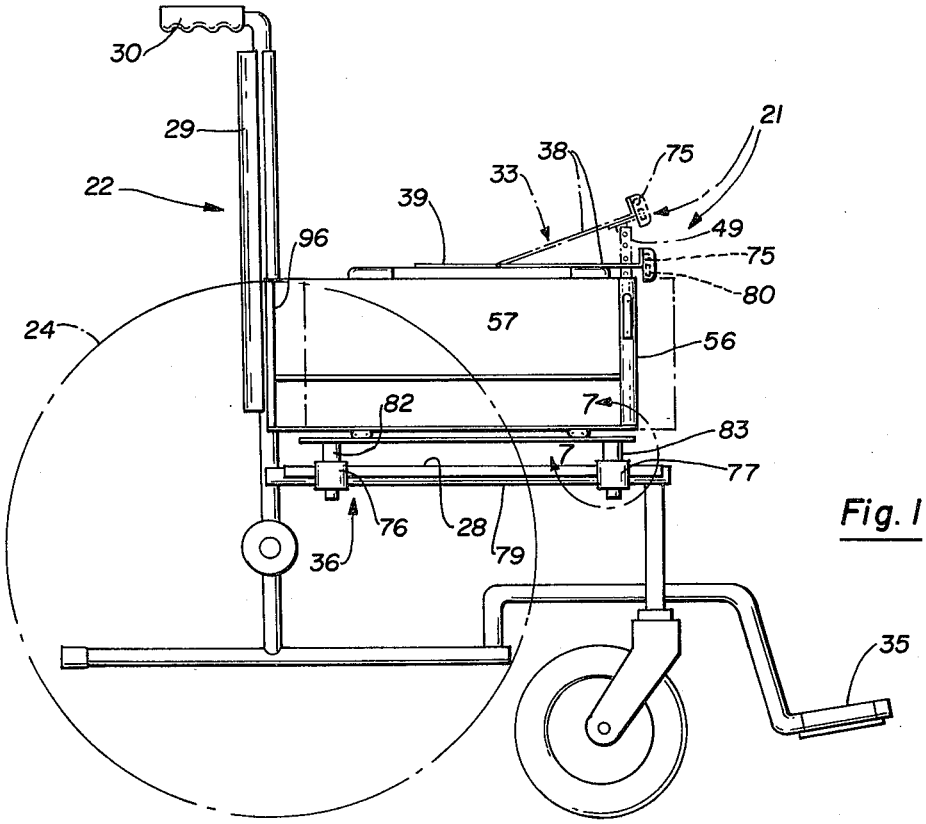
FIG. 1 is a side elevational view of a wheelchair showing a desk assembly constructed in accordance with the present invention mounted thereto and deployed across the wheelchair.

The desk assembly of the present invention, generally designated 21, is adapted for mounting to a wheelchair, invalid chair or the like. As shown in the drawing, desk assembly 21 is mounted to a wheelchair, generally designated 22, which has a pair of drive wheels 23 and 24 with hand rings 26 and 27 that can be employed by the person using the chair to propel the same. The wheelchair further includes a seat structure 28, back 29 and an armrest structure 31 mounted proximate a first side 32 of seat 28. Such wheelchairs are further conventionally provided with manually engageable handle or grip elements 30, which can be used by an attendant to propel the chair, and foot rests 35.

Desk assembly 21 of the present invention is particularly well suited for mounting to a wheelchair in that it is designed in a manner which will not interfere or conflict with large drive wheels 23 and 24 conventionally found on powered or unpowered wheelchairs. It will be understood, however, that many of the advantages of compactness, usefulness and versatility of the desk assembly of the present invention will accrue when the desk assembly is mounted to an invalid chair, or even a chair without wheels. Thus, it is contemplated that the desk assembly of the present invention may be employed with chairs other than wheelchairs.

As is conventional for desk or tray assemblies that are movably mounted to wheelchairs or the like, the present desk assembly includes desk top or surface means, generally designated 33, mounting means, generally designated 36, for mounting the assembly to wheelchair 22, and pivot means, generally designated 34, pivotally coupling desk top means 33 to the remainder of desk assembly 21.

Figure 5:
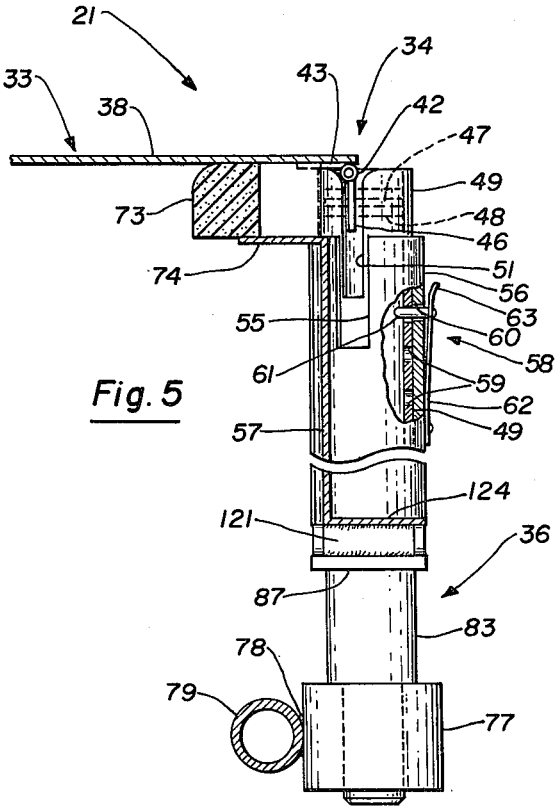
FIG. 5 is an enlarged, fragmentary, partially broken away, cross-sectional view of the desk assembly taken substantially along the plane of line 5—5 in FIG. 3.
Figure 6:
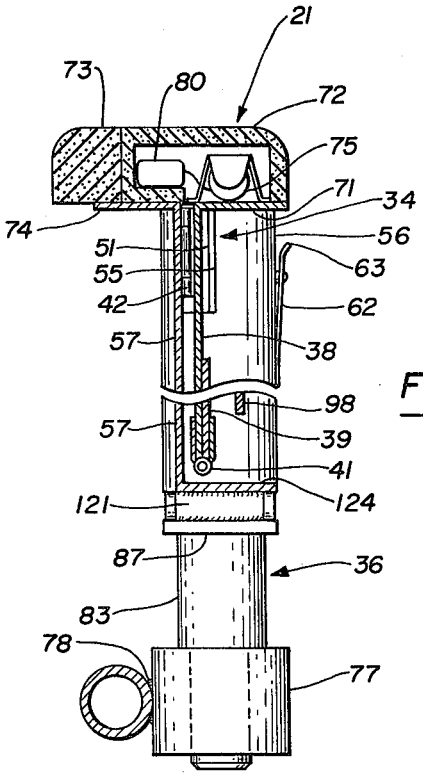
FIG. 6 is an enlarged, cross-sectional view taken substantially along the plane of line 6—6 in FIG. 4.
Figure 3:
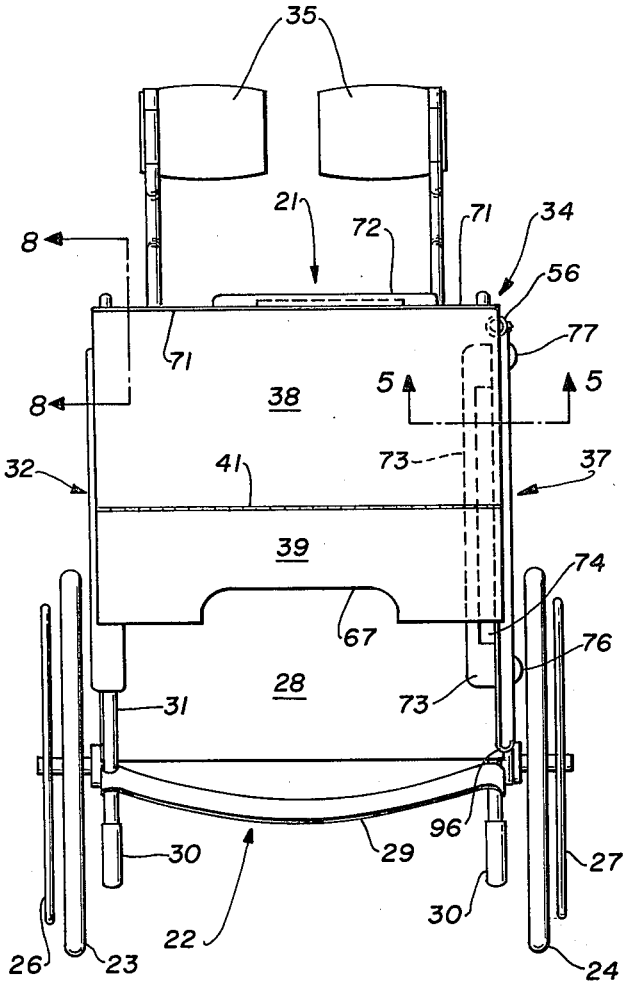
FIG. 3 is a top plan view of the desk assembly of FIG. 1 with the desk top in a deployed position.
Figure 4:
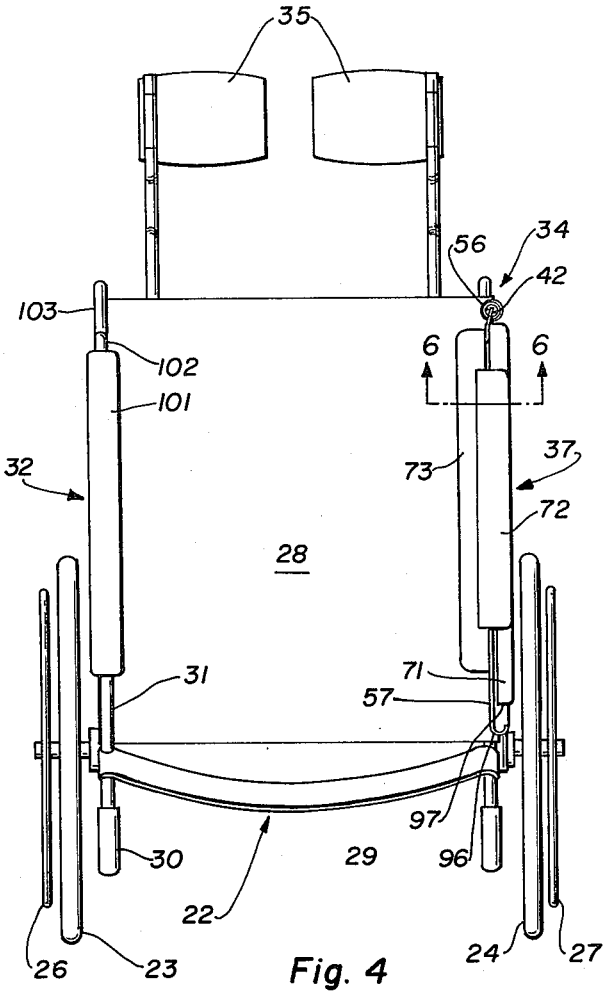
FIG. 4 is a top plan view of a desk assembly of FIG. 1 with the desk top in a stored position.

As is also broadly known in the prior art, desk assembly pivot means 34 is formed for movement of desk top means 33 to and from a deployed position (shown in solid lines in FIGS. 1, 3 and 5) in which the desk top extends across and above seat 28, and a stored position (shown in solid lines in FIGS. 4 and 6) in which the desk top is positioned proximate a side of the wheelchair. In the prior art, such a stored position usually was achieved simply by hanging the desk top along a side of the chair. As noted above, this approach is suitable for invalid chairs and chairs without wheels or other structures along the side thereof, but is generally unsuitable and undesirable for use with wheelchairs.

In the improved desk assembly of the present invention, the desk assembly mounting means 36 is formed to mount the desk assembly to wheelchair 22 proximate a second side 37 of seat 28. Moreover, desk assembly pivot means 34 is further formed for movement of desk top means 33 to a stored position located at a location at which an armrest structure for the wheelchair would conventionally be positioned. Thus, as will be seen from the drawings, it is preferable that wheelchair 22 be provided with a conventional armrest structure 31 extending along first side 32 of seat 28. The opposite or second side 37 of seat 28 is preferably not formed with an armrest structure. Instead, the desk assembly of the present invention is mounted where the armrest structure for the wheelchair would normally be positioned.

In order to provide a desk top assembly in which the desk top means is of signficant size and utility to the user of the wheelchair and yet can be stored on the wheelchair in the position of an armrest, it is further preferable that desk top means 33 be formed for selective collapsing of the same to relatively compact size and configuration substantially the same as the size and configuration of armrest structure 31. This will enable movement of the collapsed desk top the stored position of FIGS. 4 and 6.

Collapsing of desk top means 33 is preferably provided by forming the desk top from two members 38 and 39 which are hingedly secured or coupled to each other by hinge means 41 (FIGS. 1 and 6) so that the desk top member 39 can be pivotally moved or folded away from the person seated in the wheelchair about a horizontal axis extending across the seat to the collapsed condition. The collapsed condition results in the two desk top members being folded together in a side-by-side relationship that substantially reduces the bulk of the desk top.

The hinging of desk top members 38 and 39 has further advantages in addition to making the top collapsible to a more compact condition. It is an important feature of the desk assembly of the present invention to form the desk assembly pivot means 34, for selective securement of both the desk top in the deployed position with a portion, in this case member 38, of the desk top relatively elevated with respect to the remainder, in this case member 39, of the desk top. Such elevation of the desk top 33 is shown in phantom in FIG. 1. As will be described in more detail hereinafter, member 39 is secured by vertical adjustment pivot means 34 to an upwardly sloped condition, with the slope facing in the direction of the position at which a user would sit in wheelchair 22.

The details of construction and operation of the vertical adjustment pivot means 34 and the manner in which it enables movement of the desk top between the stored and deployed positions can now be described. As will be seen in FIG. 5, it is preferable that pivot means 34 include a first pivotal element 42, which is preferably a hinge having a leg 43 fastened, for example by fasteners 44, to the underside of the front right-hand corner of desk top member 38. The opposite leg 46 of hinge 42 depends downwardly and is pivotally mounted by a second pivotal element 47, which is preferably a pin.

Spacer element 48 spaces leg 46 on pin 47 from the sides of vertically oriented tubular member 49. Thus, the desk top is mounted for pivotal motion by first pivotal element or hinge 42 about an axis that is horizontal and parallel to the sides of seat 28, and additionally, the pivotal mounting of hinge leg 46 by pin 47 enables rotation of the desk top about a horizontal axis, which extends across the seat and is substantially perpendicular to the axis of hinge 42.

The provision of mutually perpendicular pivoting at pivot means 34 enables the desk top to be moved from the deployed to the stored position in the following sequence. First, member 39 is folded or collapsed onto member 38 to make the desk top more compact for storage. Secondly, the desk top is pivoted about the axis of hinge 42 from the horizontal position shown in solid lines in FIG. 1 to a near vertical position shown in solid lines in FIG. 2. Thereafter, the collapsed desk top is pivoted about axis of pin 47, as is shown in phantom lines in FIG. 2, until members 38 and 39 have been swung down to the stored position of FIGS. 4 and 6. The pivoting about hinge 42 is approximately 90°, as is the pivoting about pin 47.

In order to accommodate pivotal movement of hinge leg 46 with respect to tubular member 49, the wall of tubular member 49 is formed with notch or slot 51. Slot 51 allows leg 43 to extend outwardly of tubular member 49 when the desk top is in the stored position.

It is a further feature of the present invention to form hinge means 34 for rotation about a vertical axis. Such a rotatable mount can be provided by telescoping tubular member 49 inside a guide tube 56. Guide tube 56 preferably extends substantially over the length of tubular member 49 and is formed with a slot or notch 55 in the upper end thereof which may be aligned with notch 51 in tube 49 to accommodate hinge leg 43 when in the stored position.

In order for the desk top to pivot down into the housing 57 about pin 47, the location of pin 47 should be at a height below the top of member 49 so that when the hinge is rotated about pin 47, the side 50 of the desk top will swing outwardly of the outside diameter of guide tube 56. Thus, as can be seen in FIG. 2, the side 50 in the stored position (shown in phantom) is parallel but spaced outwardly of guide tube 56. The notch 55 accommodates pivotal movement of the leg 46 of the hinge, which can be seen from FIGS. 1 and 2 to extend outwardly of tube 49 and guide tube 56.

In order to enable vertical adjustment of the desk top member 38 so that the same can be sloped for convenience of use, it is further preferable that tubular member 49 of pivot means 34 be a vertically movable member. This can be accomplished by slidably telescoping member 49 into tubular guide member 56. Guide tube 56 is secured by welding or the like to the front end of a desk assembly housing or frame member 57 extending along the side 37 of the wheelchair. Additionally, in order to enable selective latching of vertically movable member 49 with respect to guide tube 56, it is preferable that latch means, generally designated 58, be provided. The latch means can take the form of a plurality of openings 59 formed in the side wall of vertically movable member 49, an opening 60 in guide tube 56, and a latch pin 61 movably opened through openings 59 and 60 and inwardly biased by biasing means 62 mounted to outside of tube 56. The latch can have an end 63 formed for manual engagement so as to release the vertically movable member for telescoping reciprocation inside the tube 56.

Figure 2:
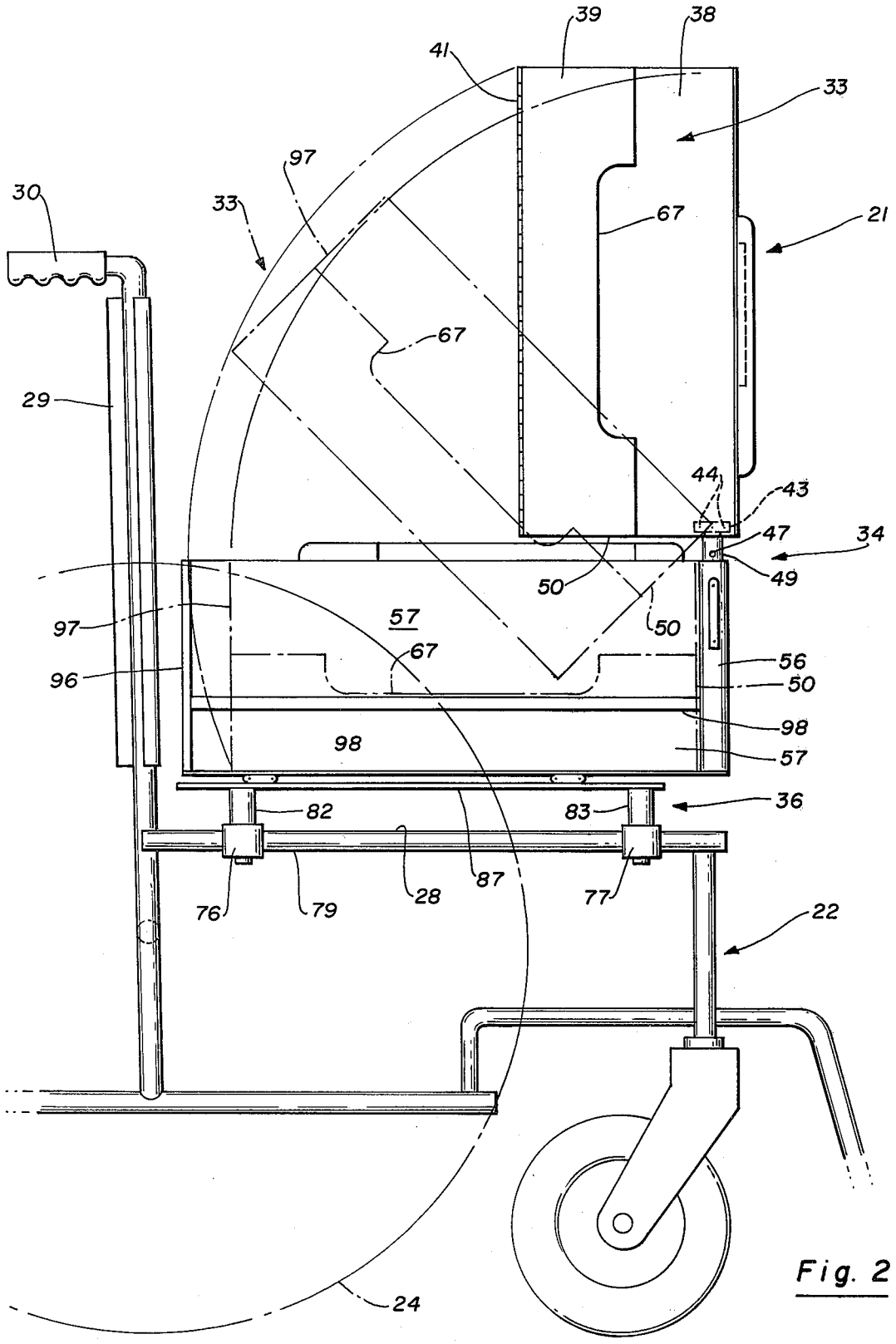
FIG. 2 is an enlarged side elevational view corresponding to FIG. 1 with the desk top shown in a vertical, moved position.

When vertically movable assembly member 49 is moved to an elevated position, as is shown in phantom in FIG. 1, the forwardmost desk top member 38 will be elevated. This causes pivoting to a limited degree about pin 47. The rearwardmost desk top member 39 remains flat, while the forwardmost member 38 is latched in a sloped condition. Hinge 41, therefore, cooperates with pivotal mounting pin 47 to accommodate sloping of the forwardmost desk member 38.

It is a further feature of the present invention that the rearwardmost desk top member 39 be formed with a recess or notch 67 in the edge thereof so as to accommodate or mate with the body of the user's wheelchair. Thus, for an unfolding of member 39 from the collapsed condition to a fully extended or deployed position results in a tray which extends right up to and partially surrounds the body of the user of the wheelchair.

It is an additional feature of the desk assembly of the present invention to provide lip means 71 protruding above the top surface of the desk top members and extending transversely across the desk top proximate the forwardmost side of the desk. Thus, lip 71 will prevent objects from inadvertently rolling forward off the desk top, particularly when the desk is in the horizontal orientation.

Since it is an important feature of the present invention to mount the desk assembly in the position of an armrest, it is further advantageous to provide an armrest support means, usually in the form of a first padding portion 72 secured to an outwardly facing side of lip means 71 and a second padding portion 73 secured to an inwardly extending flange 74 on assembly frame or housing 57. When the desk top is in the stored position, first armrest padding 72 and second padding portion 73 will both extend along the side of the seat at about the height of the top of a conventional armrest structure (best seen in FIGS. 4 and 6). When the desk top is deployed, second padding portion 73 remains as an armrest rearwardly of desk top 33 and acts as a support for the desk top.

The desk assembly of the present invention is also preferably illuminated. Thus, lip 71 and armrest padding portion 72 may advantageously have light means 75 mounted thereto and electrically connected to battery means 80. As shown in the drawing, battery 80 is mounted in a cavity in padding 72, although it will be understood that electrical conductor means can extend to batteries (not shown) mounted under seat 28 and used to power the wheelchair.

Figure 8:
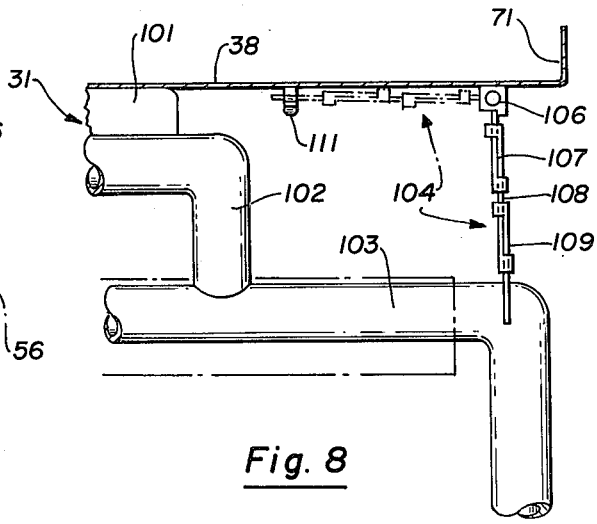
FIG. 8 is an enlarged, fragmentary, side elevational view, partially in cross-section, taken substantially along the plane of the line 8—8 in FIG. 3.

As best may be seen in FIG. 8, some wheelchairs are formed with armrest structures that are stepped. Armrest 31, therefore may be constructed with padding 101 mounted on a tubular frame member 102, which terminates short of the front of the wheelchair. Tubular frame member 102 in turn is supported on a lower or downwardly stepped frame member 103, which does extend substantially along the full length of the first side 32 of the chair. The stepped construction of armrest 31 results in the left front of desk top 33 being unsupported by the armrest. Moreover, even if the armrest 31 extends along the full length of first side 32 of the wheelchair, when the desk top is moved to a sloped position, the left front of the desk top will be elevated from the armrest.

In order to provide additional support and to eliminate the need for cantilevering of desk top 33 from pivot means 34, desk top support means 104 is carried by one of the desk top and the armrest structure. As shown in the drawing, support means 104 is pivotally mounted at 106 to desk top 33, and is formed as a series of telescoped strips 107, 108 and 109. The lowermost strip 109 is formed with a yoke-like end which will span and rest upon frame member 103. Each of strips 107, 108, and 109 may be provided with latch or detent means enabling selective locking of the strips in a plurality of different positions for support of the desk top at different heights above frame member 103. Additionally, latch means 111 may advantageously be provided for securement of support means 104 in a stored position, shown in phantom in FIG. 8.

Mounting of desk assembly 21 to wheelchair 22 is preferably accomplished by utilizing the existing armrest mounts that are conventionally employed by a large number of wheelchair manufacturers. Such armrest mounts can take the form of sockets 76 and 77 fastened, for example by welding 78 (FIGS. 5 and 6), to one of the tubular frame members 79 of the wheelchair. Sockets 76 and 77 are formed with an internal bore 81 dimensioned for receipt of a forming part of the armrest structure.

Preferably, the desk assembly of the present invention is mounted to wheelchair 22 in place of one of the armrest structures. Accordingly, the desk assembly can advantageously make use of the existing armrest mounts 76 and 77. Thus, as a further feature of the present invention to form mounting means 36 as a pair of relatively spaced-apart posts 82 and 83 which are mounted to a base member 87 on which desk assembly 21 is supported. Posts 82 and 83 can be mounted for selective movement of the spacing between the posts to accommodate the different spacings between the sockets or mounts 76 and 77 which may be employed by various wheelchair manufacturers.

Depending upon the size of the individual using the wheelchair and the task for which the desk is to be used, it may be necessary or desirable to be able to vary the distance between the desk top and back 29 of the wheelchair. Mounting means 36, therefore is advantageously formed for selective movement of the position of the desk top either forwardly or backwardly with respect to back 29.

Figure 7:
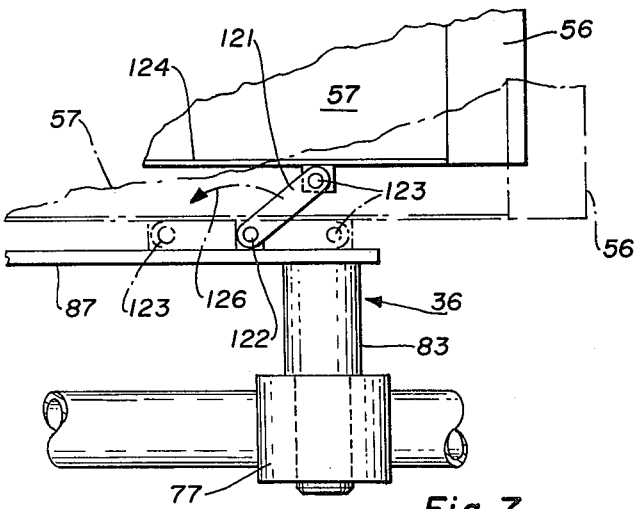
FIG. 7 is an enlarged, fragmentary, side elevational view of the area bounded by the circle 7—7 in FIG. 1.

As best may be seen in FIG. 7, this adjustment of the desk assembly is preferably accomplished by providing a linkage 121 that is pivotally mounted at 122 to base plate 87 at one end and is pivotally mounted at 123 to the bottom 124 of frame or housing 57. As shown in solid lines in FIG. 7, linkage 121 is in the process of movement (as indicated by arrow 126) from a forward position to a rearwardly displaced position, both shown in phantom.

The forward and rearward positions vary by a distance equal to twice linkage 121, and two or more linkages can be used to couple the bottom 124 of frame 57 to base plate 87. It has been found that two positions will normally provide for sufficient adjustment of the desk top, but it will be understood that frame 57 could also be slidably mounted to base plate 87 with a latching structure permitting locking in a multiplicity of moved positions of the desk top.

Since the desk assembly of the present invention is stored in the position of a conventional armrest, it is a further feature of the present invention that the desk assembly include housing means 57 formed for receipt of the desk top when in the collapsed condition and further formed to shield the desk top from interference from the clothing of the person using the wheelchair. Thus, the frame 57 is formed with an arcuate end 96 which captures or encloses the far end 97 of the desk top members from the pivotal mounting assembly 34. Additionally, the frame 57 is preferably a solid sheet-like member which provides an effective shield so that the person using the chair does not have his or her clothes become caught in any of the operating mechanisms or interfere with movement of the desk top to and from the stored and deployed positions. The guide tube 56 for vertical adjustment member 49 in effect closes the end opposite the U-shaped end 96. The housing can optionally include a solid sheet member which completes the enclosure, but in the embodiment shown in the drawing, a strip or bar 98 is provided a spaced distance from frame sheet 57 so that the stored desk top would nest between sheet 57 and bar 98.

What is claimed is:

1. A desk assembly for mounting to a wheelchair or the like having a seat and an armrest structure extending along a first side thereof, said desk assembly including desk top means, mounting means formed to mount said desk top means to said wheelchair proximate a second side thereof, and pivot means coupling said desk top means to the remainder of said desk assembly and formed for movement of said desk top means to and from a deployed position extending across and above said seat and a stored position proximate said second side of said wheelchair, wherein the improvement in said desk assembly is comprised of:

said desk top means is provided by two desk top members each formed to extend across and above said seat in said deployed position, and hinge means coupling said desk top members together for pivotal movement to a folded position about a horizontal axis extending across said seat when said desk surface means is in said deployed position;

said pivot means being secured to a forwardmost of said desk top members and being formed for movement of said desk top means after folding to said folded position by pivoting about two mutually perpendicular axes to a stored position in which the folded desk top means is positioned to extend along said second side of said wheelchair to substantially the same extent as said armrest structure extends along said first side of said wheelchair; and said desk top means being formed to fold to an overall size and configuration in said stored position substantially the same as the size and configuration of said armrest structure.

2. The desk assembly as defined in claim 1 wherein, said wheelchair is provided with drive wheels;

said mounting means is formed for positioning of said desk top means between the seat and the drive wheels of said wheelchair in said stored position; and said pivot means is further formed for selective securement of said desk top means in said deployed position with a portion of said desk top means relatively elevated with respect to a remainder of said desk top means.

3. The desk assembly as defined in claim 2 wherein, said pivot means is formed for selective securement of said portion of said desk top means in an upwardly sloped condition facing a user seated in said wheelchair.

4. The desk assembly as defined in claim 2 wherein, said pivot means further includes a pivotal element mounted to said vertically movable member and said desk top means and formed for pivotal movement of said desk top means about a horizontal axis substantially parallel to a side of said wheelchair and further formed for pivotal movement of said desk top means about a horizontal axis substantially perpendicular to the first-named axis.

5. The desk assembly as defined in claim 1 wherein, said pivot means includes: a first pivotal element formed for pivotal movement about a horizontal axis parallel to a side of said wheelchair when said desk top means is in said deployed position, a second pivotal element pivotally mounting said first pivotal element for movement about a horizontal axis extending across said wheelchair, and rotational mount means formed for rotational movement of said first and second pivotal elements about a vertical axis.

6. The wheelchair and desk assembly as defined in claim 1 wherein, said desk assembly includes housing means positioned proximate said second side of said seat and formed for receipt of said desk top means in said collapsed condition when said desk top means is moved to said stored position.

7. The wheelchair and desk assembly as defined in claim 6 wherein, said housing means is formed to shield said desk top means from interference of clothing of the person using said wheelchair with movement of said desk top means to and from said stored position in said housing.

8. The wheelchair and desk assembly as defined in claim 1, and surface support means carried by one of said desk top means and said armrest structure and formed for support of a side of said desk top means remote from said mounting means from said armrest structure.

* * * * *